US008277144B1

(12) United States Patent
Bayley

(10) Patent No.: US 8,277,144 B1
(45) Date of Patent: Oct. 2, 2012

(54) ARTICULATED HANDLE ADAPTER FOR FLOAT DRESSING CONCRETE FLATWORK

(76) Inventor: William C. Bayley, Sequim, WA (US)

( * ) Notice: Subject to any disclaimer, the term of this patent is extended or adjusted under 35 U.S.C. 154(b) by 25 days.

(21) Appl. No.: 13/045,601

(22) Filed: Mar. 11, 2011

Related U.S. Application Data

(60) Provisional application No. 61/370,237, filed on Aug. 3, 2010.

(51) Int. Cl.
*E01C 19/22* (2006.01)

(52) U.S. Cl. ..... 404/75; 404/72; 404/118; 15/235.4

(58) Field of Classification Search ..... 404/118, 404/72; 15/235.4
See application file for complete search history.

(56) References Cited

U.S. PATENT DOCUMENTS 4,197,764 A 4/1980 Auernhammer
4,397,581 A * 8/1983 Jarvis ..... 404/97
4,663,796 A * 5/1987 Helling et al. ..... 15/144.2
4,702,641 A * 10/1987 Naser et al. ..... 404/97
4,794,667 A 1/1989 Nelson et al.
5,115,536 A * 5/1992 Jarvis ..... 15/235.8
5,319,825 A * 6/1994 Fanning ..... 15/235.4
5,837,298 A * 11/1998 Face et al. ..... 425/456
7,010,828 B1 * 3/2006 Flores et al. ..... 15/235.3
7,464,432 B2 12/2008 Goller

* cited by examiner

*Primary Examiner* — Raymond W Addie
(74) *Attorney, Agent, or Firm* — Jacques M. Dulin, Esq.; Innovation Law Group, Ltd.

(57) ABSTRACT

An articulated handle adapter for concrete hand-type floats that removably connects to a long pole handle, ordinarily used with bull floats, to a hand-type float for removal of imperfections preparatory to the final finishing. The inventive adapter includes an offset and canted yoke and a canted ear which is received between the bracket arms of a pole handle sleeve. The inventive adapter eliminates the use of knee boards in the process of removal of imperfections. The inventive adapter permits the cement finisher working on slab or flatwork to float out imperfections such as deep jointer marks, bull float marks, small holes, humps and bumps and the like far into the work surface while standing off to one side outside the forms, thereby speeding the final finishing process.

14 Claims, 2 Drawing Sheets

FIG. 1
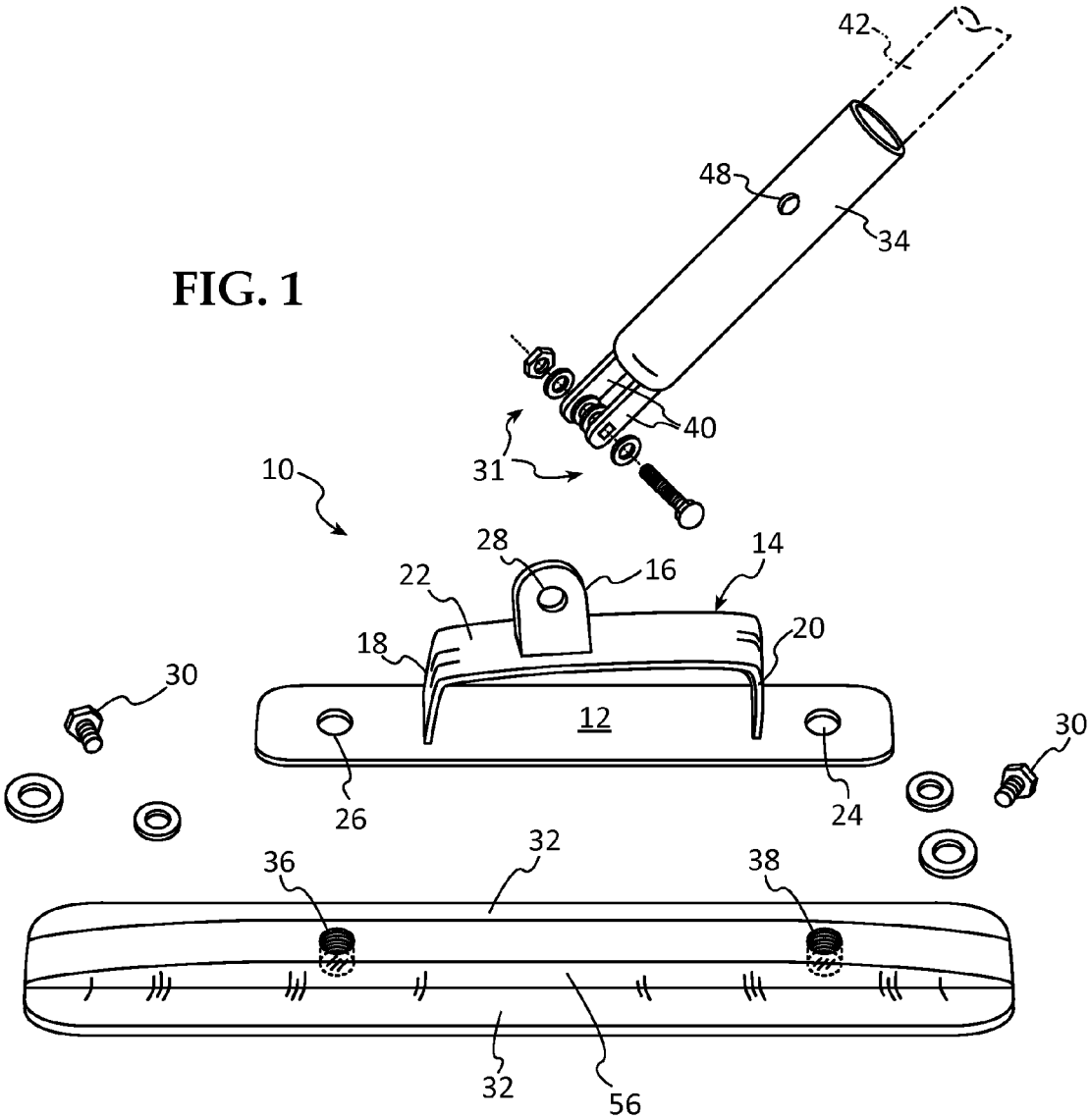
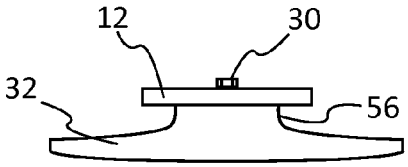
FIG. 1A

ARTICULATED HANDLE ADAPTER FOR FLOAT DRESSING CONCRETE FLATWORK

CROSS-REFERENCE TO RELATED APPLICATION

This is the Regular US Patent Application corresponding to U.S. Provisional Application Ser. No. 61/370,237 having the same title and filed by the same inventor on Aug. 3, 2010, the priority of which is claimed under 35 US Code §§119 ff.

FIELD

The invention relates to concrete finishing tools, and more particularly to an articulated handle adapter that inter-connects a long pole handle, ordinarily used with bull floats, to a float, preferably a hand-type float, which permits the cement finisher to dress concrete flatwork in preparation for finishing steps such as brushing, texturing, troweling, exposed aggregate, stamping, and the like. The inventive adapter permits the cement finisher to float out imperfections such as deep jointer marks, bull float marks, small holes, humps and bumps and the like from outside the cement work form edge boards, thereby speeding preparation for the final finishing process as the access onto the fresh concrete pour by use of knee boards is eliminated.

BACKGROUND

The concrete trade involved in flat work, including sidewalks, pads and slabs, includes a variety of concrete pouring and finishing steps, including form layout and construction, rebar cutting and installation, concrete pour, vibration of the poured concrete to eliminate voids and settle the concrete evenly throughout the form and in contact with the rebar, and the various finishing steps. These latter include using a screed board to initially form the surface evenly level from side to side and front to back of the formed area, followed by formation of expansion joints with a deep jointer tool, edge smoothing and forming with an edge tool, and floats.

For the main area, a large, wide bull float (dimensions 6-12" wide by 3-8' long, typically 4' long) that is manipulated by a long aluminum pole-type handle, is used. The handles are typically 6' in length, and multiple handles can be joined in series to make handles 6× in length, e.g., 12', 18', 24' and the like. This permits the worker standing off to the sides of the work to smooth the surface with the bull float, reaching the full dimensional area that is being poured. However, moving the bull float forward and back or side to side, and near edges and corners often leaves gouges or depressions in the concrete. For example, the forward edge of the float may dip into the concrete rather than skidding across the surface, leaving a gouge or mark. Likewise the deep jointer may leave marks, tails, ridges or unwanted gouges.

The problem here is that the depression or gouge may fill with Portland cement, but be lacking in aggregate. While it may look and may actually be level, the pure Portland cement skin is not durable when thick as needed to fill the depression, and the job is not acceptable.

Current practice is for the finisher to use a knee board placed on the surface of the fresh pour within a few feet of the imperfection. The finisher kneels on the board, and reaches out with a small hand float, which is on the order of 12" to 18" in length by 3.5" wide (the most common being 16" in length), to smooth out the imperfection. However, the knee board compresses the aggregate down into the pour, and it in turn must be reworked or filled and floated in order that the Portland cement skim coat is uniform. In addition, if the imperfection is some distance from the form edge, a number of knee boards may have to be laid out on the work in order to reach the imperfection, and each knee board depression must be reworked in series from the innermost to the edge. In large pours, there may be from 3-6 or more knee board depressions that have to be worked out per original depression or gouge.

Thus, the present practice in the field simply trades one problem for another: knee board depressions for bull float and jointer marks and imperfections. There is no known tool that permits deep reach across a wide slab for lay down, dressing or other preparation for final finishing with a hand float.

Accordingly, there is an unmet need in the art for a tool that permits long reach of a hand-type float into a work area to work out imperfections left by previous concrete working steps.

THE INVENTION

Summary, Including Objects and Advantages

The inventive articulated handle adapter for hand-type floats comprises a horizontal base plate, a yoke attached to the base plate, and an apertured ear for connection to a handle sleeve. The base plate includes a pair of holes spaced from each end of the base plate for receiving bolts to connect the inventive handle adapter to a standard hand-type or Darby float. The holes are properly spaced to align with the threaded holes in the float rib. The ear is sized to receive the spaced connector flanges of a handle sleeve, and the hole in the ear aligns with the holes in the connector flanges to receive a connecting bolt therethrough. By "hand-type" is meant any type of smaller hand floats, regardless of make, name, configuration, material of construction (wood, aluminum, magnesium, etc.) or model, used by concrete workers to smooth flatwork in preparation for final finishing.

The ear permits the inventive handle adapter to pivot around the connecting bolt in a vertical plane only, through an angle of 180°, from about +10° to about −10°, depending on whether the handle is used to manipulate the float from one side or the other.

The hand-type float mounting holes are offset along the centerline of the float so that there is a short end and a long end projecting from the base plate of the adapter. In addition, the adapter yoke has a long leg and a short leg, so that the bridge section between the legs is canted at about a 10° angle to the horizontal. The adapter is mounted to the float with the holes in the base plate aligned with the threaded holes in the float, and so that the short leg of the adapter yoke is oriented facing the long end of the float. Preferably the hand float is a rib-type float in which the back face (upward face, not the concrete finishing face) includes a central longitudinal rib on the order of 1"-2" in width, and which tapers to the float blade at each end. The threaded mounting holes are inset in the central rib. The bottom, concrete finishing face of the float is slightly convex in transverse cross-section, and the forward and rear ends are rounded.

The ear is offset on the bridge of the adapter, closer to the short leg of the yoke (the forward end) than the longer (back) leg of the yoke, so that the ear is aligned generally vertically, slightly behind the longitudinal mid-point of the float. That is, although the adapter is offset substantially toward the short end of the float, the handle sleeve pivot point is only slightly behind the approximate point of balance of the float plus adapter. Since the longer leg of the adapter adds more mass closer to the short end of the float, the sleeve pivot point at the ear can be behind the longitudinal (fore-aft lengthwise) midpoint of the float. This balance feature of the inventive adapter assembly is important, as it provides a slight upward feathering angle to the long end of the float, and permits picking up the float from the surface of the work without forward tip drag. That is, neither the forward or aft tip of the float drag due to imbalance, when the handle is raised.

The handle sleeve is bolted to the ear, but the bolts are not over-tightened so much that the handle-mounted float cannot articulate in the vertical plane. The bolt securing the sleeve to the ear is tightened sufficiently so that there is some movement of the float up and down, but not so much that the float flops when the handle is lifted. A long pole-type aluminum handle is inserted in the sleeve and is fixed by a spring detent button in the handle that aligns with, and is received in, a hole in the sleeve.

In use, the normal manipulation position is overhand. That is, the finisher holds the end or mid-point of the handle with a back hand at or above shoulder height, palm up, and the forward arm is extended, holding the pole handle closer to the float, palm down. That results in the handle being pointed downwardly at an angle toward the float/adapter assembly out on the working surface of the concrete pour, with the long end of the float forward (away from the finisher). The finisher can use a sweeping motion to smooth the imperfections in the concrete, while standing outside the forms, and without using knee boards. Thus, using the inventive adapter and handle system, the corrective finishing is accomplished faster and without creating more imperfections (one or more knee board depressions) that additionally have to be reworked. Since a long handle is used, the small hand-type float can reach any portion of the work, without necessity of using a stepping-stone array of knee boards to reach the center of the work.

The inventive adapter/handle sleeve can be flipped around 180° so that the long end of the float is toward the finisher, if that position is easier to manipulate. Of course, after floating, surface texturing may be employed where the job calls for that finish.

BRIEF DESCRIPTION OF THE DRAWINGS

The invention is described in more detail with reference to the photographic illustrations, in which:

FIG. 1 is a side ¾ elevation isometric view of the several, unassembled parts of the inventive adapter, with a float and the sleeve receiving one end of a long handle (shown in phantom);

FIG. 1A is a transverse vertical section view through the float and adapter base plate at the longitudinal mid-point of the float of FIG. 1;

DETAILED DESCRIPTION, INCLUDING THE BEST MODES OF CARRYING OUT THE INVENTION

Figure 2:
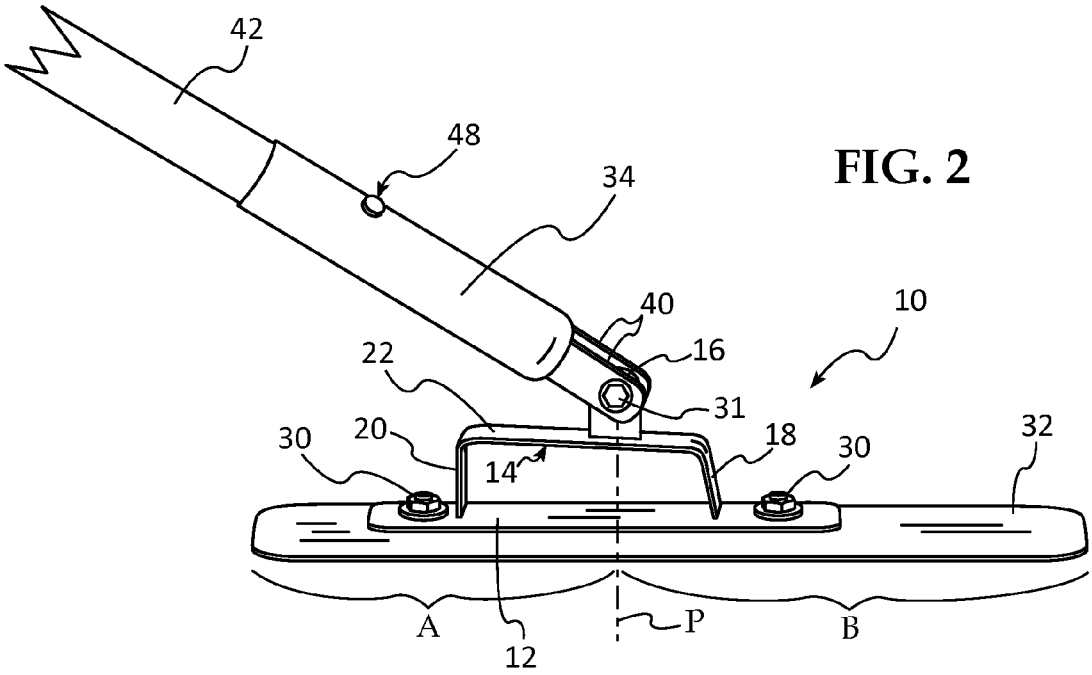
FIG. 2 is a side ¾ elevation isometric view of the inventive adapter as assembled and mounted in use position on a float, the handle sleeve pivotally mounted to the ear of the adapter and a handle inserted in the sleeve being held in place by a spring detent button.

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

FIG. 1 shows the unassembled parts of the inventive adapter 10, with the float 32 and the sleeve 34 exploded away, as a sub-assembly and kit parts of the inventive combination of adapter/sleeve/float and handle. The forward end of the base plate 12 is on the left and the rearward end is on the right. The inventive adapter 10 comprises a base plate 12 having secured thereto, preferably by welding, a yoke 14 to which is mounted, fore/aft offset, an upstanding ear 16. The yoke has a short forward leg 18, a longer rear (aft) leg 20 and a bridge 22 between the legs, to which the ear 16 is welded. Note the slant of the bridge is conferred to the ear so that the ear is canted forward (to the left in this figure). Note the yoke 14 is mounted asymmetrically on the base plate 12, closer to the rearward hole 24 and farther from the forward hole 26. The ear includes a hole 28 for receiving a bolt and washers assembly 31 to pivotally secure the adapter 10 to a handle sleeve 34 shown above the adapter 10 in this figure. The bolt 31 is preferably a carriage bolt, and one of the holes (as shown in FIG. 1) in the bracket arms 40 is square to receive the carriage bolt.

As shown in FIGS. 1 and 2, short bolts 30 of suitable length and washers are provided to secure the base plate to the raised center rib 56 of a float 32. The configuration of the center rib 56 of float 32 is shown in a transverse vertical section view of FIG. 1A. That view is taken at the longitudinal midpoint of the float shown in FIG. 1, that is at the point where lead lines 32 are shown contacting the float in FIG. 1. Bolts 30 secure the baseplate onto the rib of the float 32 by being secured in the threaded holes 36 and 38 in the rib 56. Then a bolt 31 is used to secure the ear 16 between the bracket arms 40 of the handle sleeve 34. One or more of the two spacer washers inserted between the bracket arms 40 may be omitted where the bracket arms are so closely spaced-together that the ear 16 fits snugly but not tightly; those washers are optional and may not be needed. FIG. 1A also shows the slightly concave bottom surface of the float 32.

FIG. 2 shows the inventive adapter 10 assembled onto a float 32. In this figure, the forward end is to the right and the rearward end is to the left. In this figure the short leg 18 of the yoke is toward the long end B of the float, and the short end of the yoke toward the short end A, of the float. This figure also shows the ear 16 secured by bolt 30 between the bracket arms 40 of the handle sleeve 34, and with a handle 42 inserted in the sleeve 34, being retained in place by spring biased detent pin 48. The several offset and angular relationships are clearly seen as contributing to use functionality.

Figure 3:
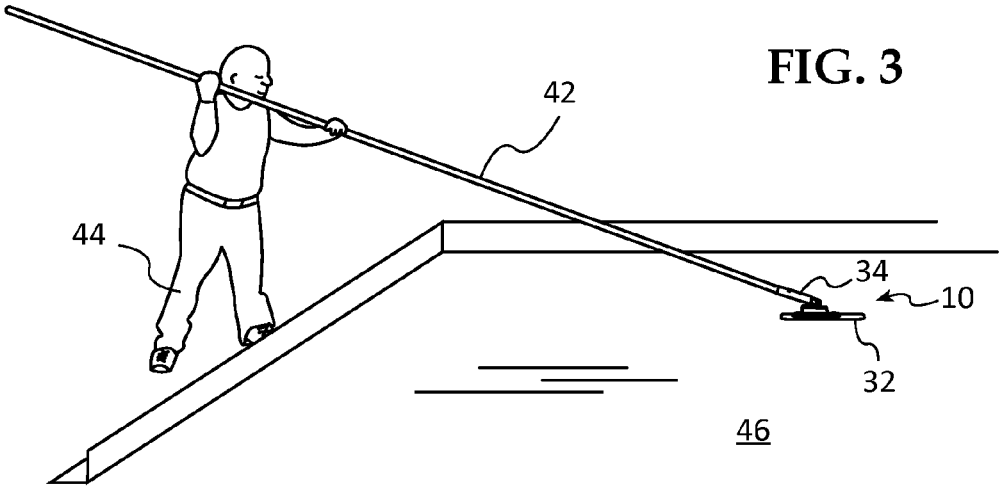
FIG. 3 is an isometric side view showing the use position, with a finisher (worker) holding the pole in the overhand grip, the float being used to smooth an imperfection far out in the work but without the need for a knee board

FIG. 3 shows the use position of the inventive adapter 10 and float 32 combination, with the finisher 44 holding the pole 42 in an overhand grip, the float 32 being used to smooth an imperfection far out in the work 46 but without the need for a knee board.

Comparing FIGS. 2 and 3, note the short leg of the yoke 18 is forward, and the longer back leg 20 is to the back. The pivot P falls aft of the longitudinal (lengthwise) center of the float, between the aft short section A and forward long section B of float 32. Note also the forward cant of the ear, and that it has a vertical dimension high enough to permit the forward bottom corners of the sleeve bracket arms 40 to clear (not bind on) the bridge piece 20. This permits good articulation of the handle with respect to the adapter/float assembly, but without the float flopping about uncontrollably. In addition, the float rides at a slight upward angle from back to front, on the order of 1°, so that the forward, longer end tip does not dig into the concrete as it is being pushed forward or swept from side to side. This also feathers the sweep strokes on the concrete surface, making a superior smooth finish.

INDUSTRIAL APPLICABILITY

It is clear that the inventive hand-type float adapter has wide applicability to the concrete trade, namely to the pre-finishing phase of flat and slab work. The inventive adapter is easily retrofit to standard long pole handle sleeves, and clearly will speed preparation for the finishing process by eliminating the use of knee boards. Thus, the inventive system has the clear potential of becoming adopted as the new standard for dressing and preparation for finishing in the concrete flatwork trade.

It should be understood that various modifications within the scope of this invention can be made by one of ordinary skill in the art without departing from the spirit thereof and without undue experimentation. For example, the base plate can have a wide range of sizes and location of mounting holes to permit securing of the adapter to a wide range of floats, including floats that use bosses instead of center ribs. The parts may be riveted or bolted together rather than welded, or reversed, e.g. a single bracket 40 on the sleeve and double ear 16 on the yoke 14. In addition, the adapter may be finished with powder coating rather than paint. This invention is therefore to be defined by the scope of the appended claims as broadly as the prior art will permit, and in view of the specification if need be, including a full range of current and future equivalents thereof.

I claim:

1. A freely articulating adapter for a concrete hand float for finishing slab or flat work comprising in operative combination:

a) a generally planar base plate having an upper and a lower face, and holes therethrough for securing said base plate to a float;

b) a yoke secured to said upper face of said base plate, said yoke including an ear for receiving a handle sleeve;

c) a handle sleeve having at least one bracket for pivotally securing said sleeve to said yoke ear, said sleeve receivingly engaging a long handle, so that said handle bracket freely articulates in a vertical plane on said yoke ear pivot to permit continuous change of angle during in-use movement; and d) said yoke being mounted on said base plate and said holes in said base plate being disposed to balance a float attached thereto so that said adapter enables a finisher to smooth gouges and depressions in concrete work from outside edge formwork without the use of knee boards.

2. An articulated adapter as in claim 1 wherein said yoke comprises a short forward leg, a longer rearward leg and a bridge piece therebetween so that bridge piece is canted downwardly from said rearward leg to said frontward leg, and said ear is mounted on said bridge piece.

3. An articulated adapter as in claim 2 wherein said base plate float mounting holes are offset with respect to said yoke so that a rearward mounting hole in said base plate is closer to said longer rearward leg of said yoke than a forward mounting hole in said base plate.

4. An articulated adapter as in claim 3 wherein said base plate, as mounted on a float, is mounted offset on said float, so that the length of said float from a rearward end to the center of said ear is shorter than the length of said float from the center of said ear to a forward end of said float.

5. An articulated adapter as in claim 4 wherein, as mounted on a float, the float rides at a slight upward angle from back to front so that the forward, longer end tip of said float does not dig into the concrete as it is being pushed forward or swept from side to side by said finisher.

6. An articulated adapter as in claim 1 which includes a planar float having threaded recesses in, or threaded bosses on, a top surface for receiving mounting bolts to mount said base plate thereto.

7. An articulated adapter as in claim 1 which includes bolts to mount said base plate to a float, and to pivotally secure said sleeve to said ear, as a kit.

8. An articulated adapter as in claim 6 which includes bolts to mount said base plate to said float and to pivotally secure said sleeve to said ear, as a kit.

9. An articulated adapter as in claim 7 wherein said kit includes spacer washers and a carriage bolt to secure said adapter ear to said handle sleeve bracket.

10. An articulated adapter as in claim 8 wherein said kit includes spacer washers and a carriage bolt to secure said adapter ear to said handle sleeve bracket.

11. An articulated adapter as in claim 6 which includes a long handle having a spring detent positioned to engage a hole in said sleeve to removably secure said handle in said sleeve.

12. An articulated adapter as in claim 8 which includes a long handle having a spring detent positioned to engage a hole in said sleeve to removably secure said handle in said sleeve, as a kit.

13. A method of finishing a planar concrete slab or flatwork pour of width greater than the span of human reach, said pour having gouges or depressions in the surface thereof that are disposed generally centrally thereof, comprising the steps of:

a) providing a freely articulating adapter comprising a generally planar base plate having an upper and a lower face, and holes therethrough for securing said base plate to a float; a yoke secured to said upper face of said base plate, said yoke including an ear for receiving a handle sleeve; a handle sleeve having at least one bracket for pivotally securing said sleeve to said yoke ear so that said handle bracket freely articulates in a vertical plane on said yoke ear pivot to permit continuous change of angle during in-use movement, said sleeve receivingly engaging a long handle; said yoke being mounted on said base plate and said holes in said base plate being disposed to balance a float attached thereto;

b) mounting said articulated adapter base plate to a float so that said float has a long, forward portion and a shorter rearward portion, as measured between ends of the float and said adapter ear;

c) mounting a long handle to said articulated adapter sleeve;

d) orienting said mounted float so that said forward portion is toward an area of said pour that needs finishing; and d) manipulating said float by said handle so that said adapter enables a finisher to smooth gouges and depressions in concrete work from outside the edge formwork of said pour without the use of knee boards.

14. Method as in claim 13 wherein said yoke and base plate is mounted on said float so that said float rides at a slight upward angle from back to front so that the forward, longer end tip of said float does not dig into the concrete as it is being pushed forward or swept from side to side by said finisher.

* * * * *